United States Patent [19]

Duperret

[11] 4,320,585

[45] Mar. 23, 1982

[54] AUTOMATIC DRYING INSTALLATION

[76] Inventor: Jean Duperret, Castelnaud de Gratecambe, 47290 Cancon, France

[21] Appl. No.: 816,790

[22] Filed: Jul. 18, 1977

[30] Foreign Application Priority Data

Jul. 16, 1976 [FR] France ..... 76 22175

[51] Int. Cl.[3] ..... F26B 19/00

[52] U.S. Cl. ..... 34/66; 34/210; 34/213; 34/216

[58] Field of Search ..... 34/66, 210, 212, 213, 34/216; 198/DIG. 95 Z, DIG. 95 D; 99/467, 470, 483, 516, 517, 64, 6 R

[56] References Cited

U.S. PATENT DOCUMENTS 3,216,127 11/1965 Ruff ..... 34/66

*Primary Examiner*—J. L. Barr

*Attorney, Agent, or Firm*—Pollock, Vande Sande & Priddy

[57] ABSTRACT

An apparatus for drying fruits or other products comprises a drying unit and a connected cooling unit having conveyors therein for moving products to be dried from the cooling unit through the drying unit and then back to the cooling unit in a succession of cycles. Hot air from a heating unit is supplied to the end of the drying unit adjacent the cooling unit, and is directed through the drying unit away from the cooling unit for exhaust from the end of the drying unit remote from the cooling unit whereby, as the products being dried move through the drying unit away from the cooling unit they pass successively through air which is increasingly less hot and less dry and as said products thereafter move through the drying unit back toward the cooling unit they pass through air which is increasingly hotter and drier before reaching the cooling unit to start a new cycle.

17 Claims, 18 Drawing Figures

AUTOMATIC DRYING INSTALLATION

The present invention relates to drying installations which make it possible to heat and cool fruits and other products alternately during drying thereof, and which are capable of operating continuously and automatically.

French Pat. No. 1 143 747 dicloses an installation for drying cereals in which the products to be dried are first heated and then cooled, and the hot air and the cold air are passed vertically and upwards through superimposed conveyors on which the products pass successively. The temperatures are therefore the same in all the stages of the installation. This method of dehydration is not suitable for products such as fruits, because those which are thoroughly ripe dehydrate more easily than the others which are larger and contain less sugar. Other driers are also known in which the fruits are placed on wooden or metal trays; these trays are placed on top of one another and on trolleys or trucks which are themselves then introduced into the drying installation by means of a winch or a thrust jack. All these operations call for a great deal of labor. Furthermore, as the fruit remains in the drying installation during the entire period of the dehydration there is a great heterogeneity in the final moisture content of the products, as indicated for the installation known from the abovementioned French Patent.

The aim of the present invention is to avoid the drawbacks of the known installations. For this purpose, a process according to the invention for drying fruits and other products, continuously and automatically, by means of heating and cooling units alternately traversed by conveyors on which the products are placed, is characterized by the fact that the products to be dried pass alternatively into the cooling unit and then into a drying unit commencing with the cooling unit, and by the fact that the hot air coming from the heating unit circulates in the drying unit from the end of the latter adjacent to the cooling unit, so that the products move in the drying unit successively through air which is less and less hot and dry and then through air which is more and more hot and dry before reaching the cooling unit and starting a new cycle.

Preferably, the heating unit is situated above the drying unit and is arranged in such a way that the hot air arrives downwards through two vertical ducts situated on either side of the conveyors at the end of the drying unit adjacent to the cooling unit, flows along the conveyors as far as the end of the drying unit opposite the cooling unit, and leaves upwards through a vertical corridor and then through two parallel chimneys which separate it from the heating unit.

An installation for carrying out the process according to the invention comprises superimposed conveyors equipped with drive devices which pass alternately through a cooling unit and a drying unit and carry the products to be dried from a feed unit and then discharge them after drying, and is characterized by the fact that: (a) it also comprises a heating unit situated above the drying unit and separated from it by a horizontal partition; (b) the drying and cooling units have the same height and are separated vertically by flaps arranged between the conveyors and between the sections of each of these conveyors; and (c) the feed unit is capable of swivelling between its position of rest and its charging position as a result of the action of two jacks.

On the attached drawings two embodiments of the invention have been shown diagrammatically and by way of example.

In the different figures, parts which are identical bear the same references and parts which are modified bear the same references followed by a prime notation (').

Figure 1:
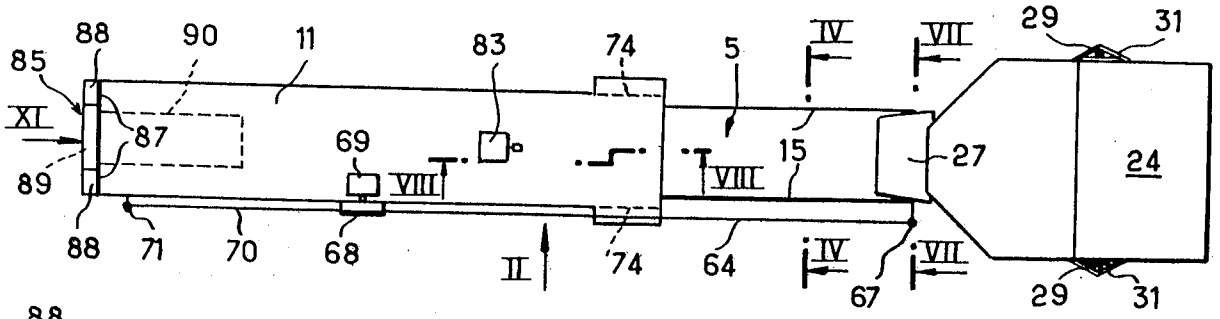
FIG. 1 is a view from above of a first example of an installation.
Figure 2:
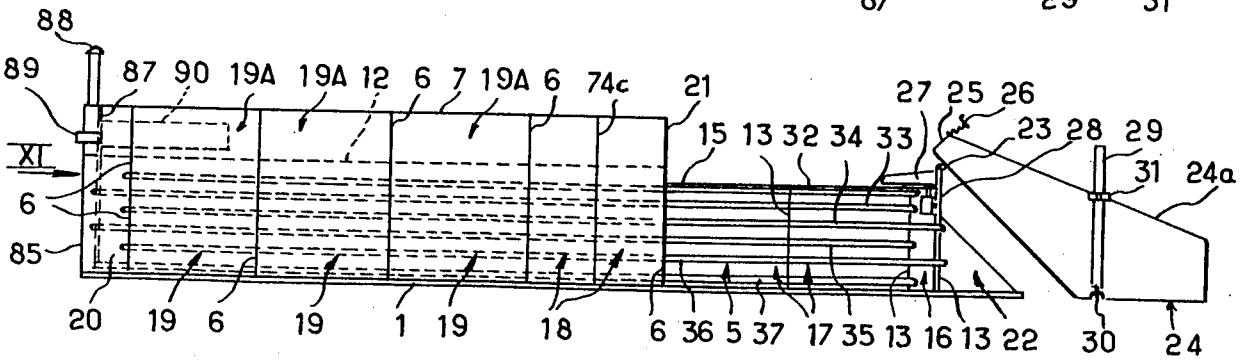
FIG. 2 is a side elevation along the arrow II of FIG. 1.
Figure 3:
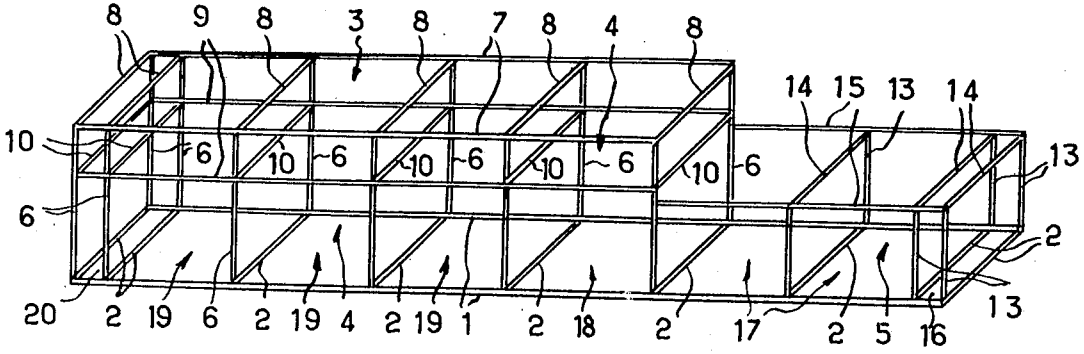
FIG. 3 is a highly simplified perspective of the frame of the installation of FIGS. 1 and 2.
Figure 11:
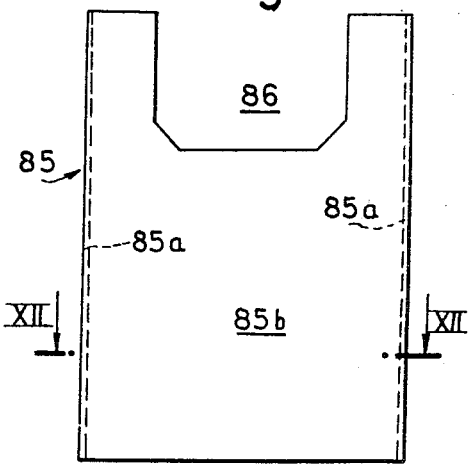
FIG. 11 is an end view in the direction of the arrow XI of FIG. 1 or 2.
Figure 12:
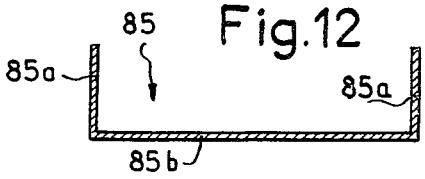
FIG. 12 is a horizontal section along the line XII—XII of FIG. 11.

In FIGS. 1 to 3, one can see that the frame of an installation according to the invention comprises a lower frame formed of two stringers 1 (FIGS. 2 and 3) connected by crosspieces 2 of varying number. This frame serves as a common base for a block comprising an upper heating unit designated as a whole by 3, and a lower drying unit designated as a whole by 4, and a cooling unit of a lower height, designated as a whole by 5. The block 3, 4 comprises pairs of uprights 6, for example six in number if the number of crosspieces 2 is nine, as in the example shown in the drawing, connected at their tops by two parallel upper stringers 7 and crosspieces 8 aligned vertically with the crosspieces 2, and at a point in their height by two intermediate stringers 9 and intermediate crosspieces 10 aligned with the crosspieces 2 and 8. The stringers 7 and the crosspieces 8 serve as supports for an upper wall 11, and the stringers 9 and the crosspieces 10 serve as a support for an intermediate wall 12 which separates the heating unit 3 from the drying unit 4. As regards the cooling unit 5, it comprises uprights 13 arranged in pairs, of a height which is at most equal to that which separates the frame 1, 2 from the wall 12, and which are connected at their upper ends by crosspieces 14 aligned vertically with the crosspieces 2 and by two stringers 15. One end of each stringer 15 forms an edge of a trirectangular trihedron, the uprights 13 and the crosspieces 14 of which form the other two edges and the other end is fixed to the nearest upright 6. The number of pairs of uprights 13 is, for example, three in the example shown in the drawing. Preferably, rectangular parallelepipeds formed by the various units of uprights, crosspieces and stringers constitute "modules" of equal dimensions in the longitudinal direction of the installation, with the exception of at least the one which is located at the front end of the installation, that is to say the one through which the products to be dried are fed in, and which has a length which is much less than that of the others. In the rest of the description, the reference 16 will be used to designate the front module and the reference 17 will be used to designate other modules of the cooling unit 5; the reference 18 will be used to designate the front module common to the heating unit 3 and drying unit 4; the reference 19 will be used to designate the intermediate modules common to these units; and the reference 20 will be used to designate the rear module of these units. The module 18 possesses solid movable walls which constitute corridors of circulation for the drying air and will be described in greater detail with reference to FIG. 10. The modules 19 are completed by solid movable side walls 19A (FIG. 2), and module 20 is completed by walls which close the rear ends of the heating unit 3 and the drying unit 4 and will be described with reference to FIGS. 11 and 12. As regards the heating unit 3, it is closed at its front end by a vertical plate 21 (FIG. 2).

At the free end of the module 16, the uprights 13 are reinforced by supports designated as a whole by 22 and also fixed to the stringers 1.

A feed unit capable of swivelling in relation to the supports 22 around a horizontal spindle 23 at right angles to the longitudinal axis of the installation comprises a storage hopper 24, the shape of which is easily visible in FIG. 2 and the bottom of which comprises a part which is capable of resting on the ground and an inclined part, for example at an angle of 45°, up to a certain height above the axis 23; the upper end of the hopper, which can be closed by a trapdoor 25, the opening of which is carried out by means of a crank 26, forms a tipping vessel situated above a chute 27 mounted on the upper part of the cooling unit 5 and preferably used in association with a vibrator 28 carried by the front uprights 13 of the cooling unit. The swivelling of the hopper 24 around the spindle 23 is produced by two jacks 29 (FIGS. 1 and 2) arranged on each side of the hopper, fixed to the ground at the end of their rod by articulated plates 30 (FIG. 2), and the cylinder of which is maintained by bearings 31 fixed along the upper inclined edges 24*a* of the hopper.

The conveyors which circulate the products to be dried inside the installation may be belt conveyors of any type. In FIG. 2 it can be seen that the installation comprises six superimposed conveyors, 32 to 37, the method of drive of which will be described later on, and which are arranged longitudinally in the drying unit 4 and cooling unit 5. As is shown by FIG. 2, the conveyors 32 to 37 are arranged in a classic manner, that is to say they have the same length but they are staggered longitudinally from one level to the next. In other words, the products tipped by the chute 27 on to the upper section 32 situated to the right of FIG. 2 fall on the left of this figure to the projecting end of the conveyor 33, and so on. All these conveyors are identical, and one of them is represented by way of example in a transverse section in FIG. 4.

It can be seen from this figure that each section 38 of the metal belt which forms the conveyor is guided and driven by transverse support units extending over the whole of its width and comprising an outer channel iron 39 and an inner flat iron 40 between which the section is imprisoned and which are connected by rivets 41. Brackets 42 which are integral with endless chains 43 and one branch of which is fixed by a rivet 41 against the surface of the angle iron 39 in contact with the surface of the belt ensure the drive of this belt as will be described later on. These chains rest on angle irons 44 carried by the uprights 13 (or 6) and separated vertically by a distance equal to that which separates the free surfaces of two sections of the metal belt.

Figure 5:
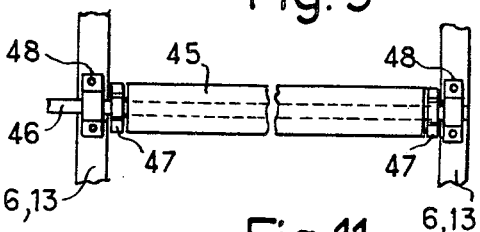
FIG. 5 is a view from which a part has been stripped away to show a drive roller for the conveyor of FIG. 4.

In FIG. 5 it is seen that the drive of each conveyor is carried out by means of a drum 45 over which the metal belt passes and which is integral with a shaft 46 on which, on either side of the drum, there are keyed cogwheels 47 with which the chains 43 (not shown in FIG. 5) mesh. The shaft 46 is mounted in bearings 48 carried by uprights 6 or 13, as shown in FIG. 5.

Figure 6:
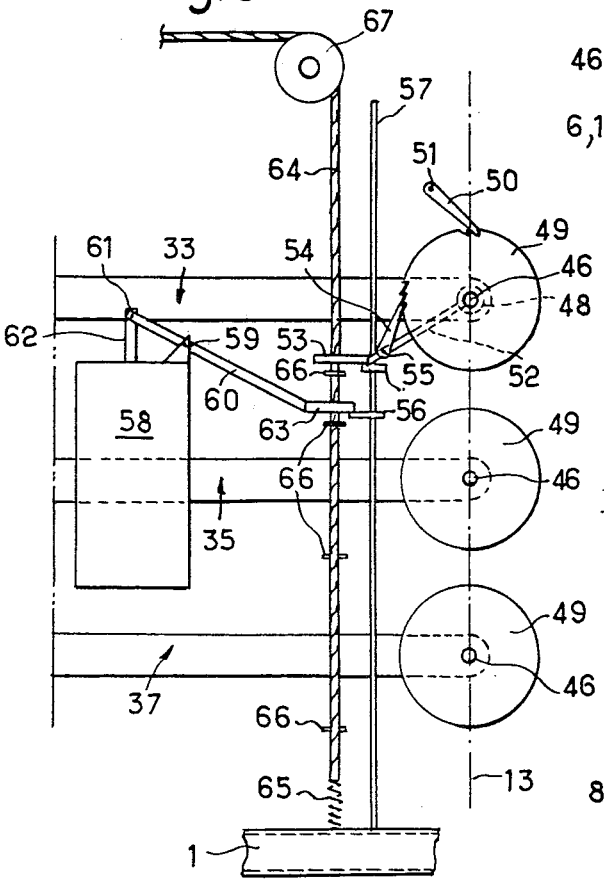
FIG. 6 shows diagrammatically the principle of operation of the three conveyors, the end of which is nearest to the free end of the cooling unit.

In FIG. 6 one can see a mode of embodiment of a drive device for the conveyors 33, 35 and 37 by their ends situated at the front of the installation, that is to say on the right-hand side of FIG. 2, because it is preferable for the drive to be carried out at the discharge end and not at the end on which the products to be dried are deposited, and it would therefore be useless to show the other three conveyors, the ends of which would be visible and would not possess the drive device.

At one end of the shaft 46 of each conveyor there is fixed a ratchet wheel 49 (also visible in FIG. 7) with which there collaborates a pawl 50 pivoted at 51 on a spindle (not shown in the drawing) and carried by the front upright 13 which is located on the side of the cooling unit 5 situated at the bottom of FIG. 1. To the bearing 48 (FIG. 5) associated with this end of the shaft 46 mentioned above there is fixed an arm 52, at the opposite end of which there is fixed a slide 53. At a certain distance from this slide 53, a drive pawl 54 is pivoted at 55 to the arm 52. An adjustable stop 56 is located below the slide 53 on a vertical support 57 fixed by its ends (only the lower end being shown in the drawing) to the module 16. A hydraulic pump 58 which actuates the jack 29 is supported, via two horizontal channel irons not shown in the drawing, on the uprights 13 of the module 16. At the top there is articulated at 59 an arm 60, one end of which is pivoted at 61 on the piston 62 of the pump 58 and the other end of which carries a slide 63 above which there is placed another adjustable stop 56. The arm 60 is situated in such a way that the slide 63 is located between the slide 53 associated with the conveyor 33 and the corresponding slide associated with the conveyor 35, which means that the pump 58 is located practically halfway up the cooling unit 5. For greater simplicity, the devices comprising the pawls 50 and 54, the arms 52 and the slides 53 associated with the conveyors 35 and 37 have not been shown in FIG. 6.

A drive cable 64 passes into the slides 53 of the drive units of the three conveyors and into the slide 63 of the arm 60 associated with the pump 58. The cable 64 is fixed at its lower part to a stringer 1 by means of a spring 65 and it has four cursors 66 positioned and locked as required and associated with the three slides 53 of the conveyors and with the slide 63 of the pump. The cursor 66 associated with the slide 63 serves to regulate the output of the pump 58 and in this way to synchronize the tipping of the products to be dried from the hopper 24 according to the speed of the conveyors and according to the position of the stops 56. A return pulley 67 (FIGS. 1 and 6) is fixed to the top of the installation and enables the cable 64 to be connected to a crank plate 68, the eccentricity of which is adjustable, driven by a motor reducing gear 69 (FIG. 1) carried by the upper wall 11 of the heating unit 3. To this crank plate there is also fixed a cable 70 similar to the cable 64 and which, via a return pulley 71, actuates the drive device of the conveyors 32, 34 and 36, which is identical with that which has just been described with reference to FIG. 6, except that it does not have a pump such as 58.

Figure 7:
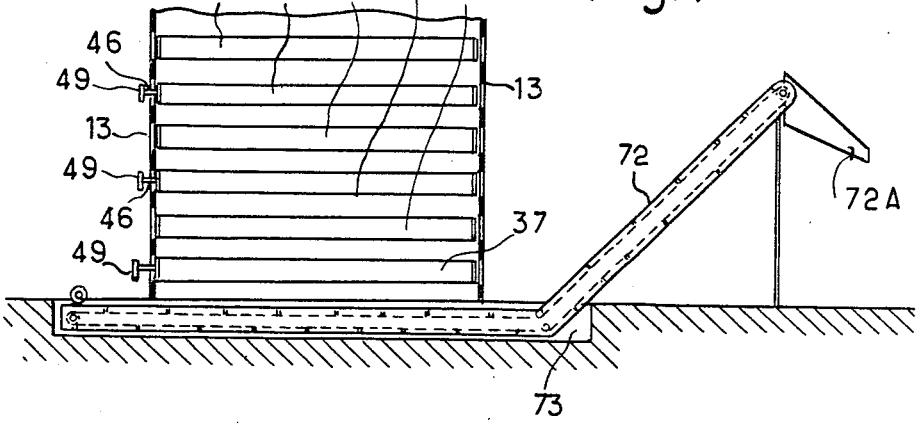
FIG. 7 is a section along the line VII—VII of FIG. 1 and shows the conveyor for the discharge of the dried products.

In FIG. 7 one sees at 72 a conveyor for discharging the dried products consisting of a belt conveyor arranged at right angles to the longitudinal direction of the installation so that its central axis coincides with the end of the conveyor 37 and so that its center is located in the axis of the drum 46 and at a certain distance below the latter, preferably in a pit 73. At the discharge end of the belt 72 it is possible to fit an articulate chute 72A.

Figure 8:
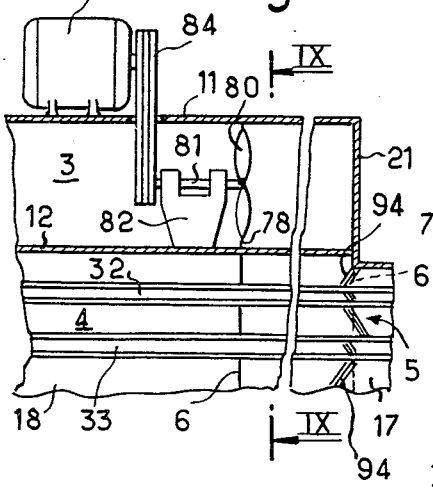
FIG. 8 is a section along the line VIII—VIII of FIG. 1, with partial stripping away, and shows the front end of the heating unit, the front end of the upper part of the drying unit and the rear end of the upper part of the cooling unit.
Figure 9:
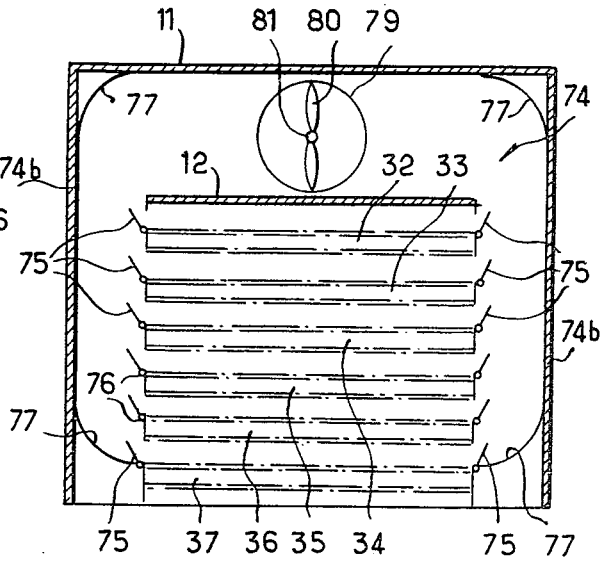
FIG. 9 is a section along the line IX—IX of FIG. 8.
Figure 10:
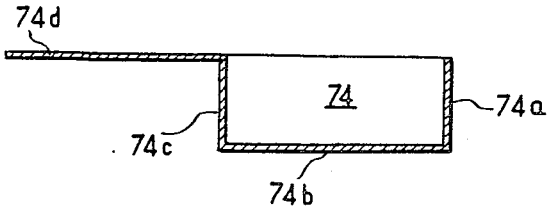
FIG. 10 is a horizontal section showing the shape of a duct or of a corridor for the circulation of hot drying air.

In FIGS. 8 to 10 one can see a mode for the circulation of drying air through the installation.

In the module 18 there are arranged two circulation corridors (or ducts) 74 through which the drying air flows downwards so as to arrive between the conveyors forming a pair. As can be seen from FIG. 1, these ducts are closed at their upper end either by separate horizontal walls or by lateral extensions of the upper wall 11 of the heating unit 3, and they are closed at their lower end by plates, not shown in the drawing, fixed to the stringers 1 and to the crosspieces 2. Each corridor has a rectangular cross-section in plan view (FIG. 10) bounded by walls 74*a*, 74*b*, 74*c* in one piece with a wall 74*d* situated in a plane parallel to the wall 74*b* and fixed in a removable manner to one of the uprights 6 which separate the modules 18 and 19, the wall 74*a* being fixed to the upright 6 associated with it, which separates the drying unit 4 and the cooling unit 5 (FIG. 2).

Figure 4:
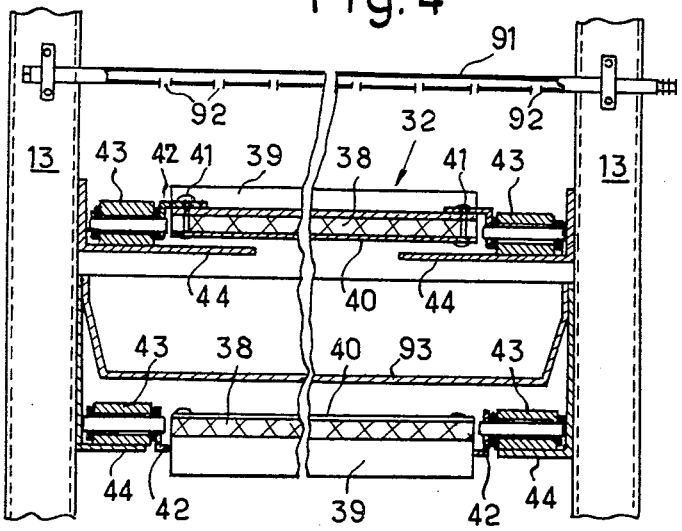
FIG. 4 is a section along the line IV—IV of FIG. 1 and shows a mode of embodiment of a conveyor.

Shutters 75 (FIG. 9) are pivoted at 76 inside each ventilation corridor 74, on angle irons 44 which can be seen in FIG. 4, so as to make it possible to close the spaces which separate vertically on the one hand the wall 12 of the upper conveyor 32 and on the other hand the conveyors of any pair. Handles located on the outside of the installation at one end of each pivot 76 but not shown in the drawing, make it possible to adjust the position of the shutters 75. Deflectors 77 may be fixed at the top and bottom of each corridor 74.

To the uprights 6 common to the two modules 19 situated on the left of FIG. 2 there is fixed a vertical plate 78 (FIG. 8) which extends from the intermediate wall 12 to the upper wall 11 between the uprights 6. In the center of this plate there is provided an aperture 79 (FIG. 9) inside which there is arranged a fan 80 fixed on to a shaft 81 which is mounted in two bearings 82 connected in any suitable manner to the intermediate wall 12.

This fan is driven from a motor 83 (FIGS. 1 and 8) carried by the upper wall 11 of the beating unit 3, via a transmission 84 consisting of a chain or a belt (FIG. 8) which drives the shaft 81.

In FIGS. 1 to 3, 11 and 12, it is possible to see that the rear end of the installation (to the left in FIGS. 1 and 2) is closed by solid walls, the cross-section of which in a horizontal plane is that of a U (FIG. 12) designated as a whole by 85. The branches 85*a* of the U are fixed to the two pairs of uprights 6 which bound the module 20. The base 85*b* of the U is cut in at 86 (FIG. 11) in its middle upper part, over a height equal to that of the heating unit 3, so as to receive a parallelepiped heating block which will be described in greater detail with reference to FIGS. 15 and 16. Between the surface of this block which is parallel to the base 85*b* and the branches 85*a* of the U there are fixed plates 87 (FIGS. 1 and 2) which bound on either side the heating block, two vertical columns extended above the upper wall 11 by chimneys 88 for the discharge of the air charged with moisture. In the rear wall of the heating block there is arranged an aperture to take a burner 89 (FIGS. 1 and 2) with which there is associated, by means of a suitable connection, a combustion chamber 90 situated partly in the above-mentioned block but which extends to the interior of the heating unit 3, leaving a peripheral space for the intake of air from the outside, as will be described later on.

In certain cases it is necessary or at least advantageous to wash the products to be dried before starting their treatment. FIG. 4 shows a washing unit fixed to the frame formed by the stringers 13 and the crosspieces 10 (FIG. 3) at a certain distance behind the chute 27 (FIG. 2), consisting of at least one spinkler pipe 91 drilled with apertures 92 to let out jets of water, and extending over the entire width of the upper conveyor 32. When the water has crossed the upper section 38 of the conveyor belt and washed the products which are located on it, it is recovered in a trough 93 located between the sections 38.

Furthermore, it is necessary to provide for a separation between the drying unit 4 and cooling unit 5, so that the hot air cannot get into the cooling unit. As is shown by FIG. 8, this separation is advantageously carried out by means of flaps 94 arranged between the conveyors 32 to 37 and between the two sections of each conveyor.

It is also advantageous to provide for a device which makes it possible to recycle at will at least a part of the air charged with moisture instead of letting it escape completely into the atmosphere through the chimneys 88 mentioned above. An installation comprising such a device and certain elements of which are also modified is shown in FIGS. 13 to 27.

Figure 14:
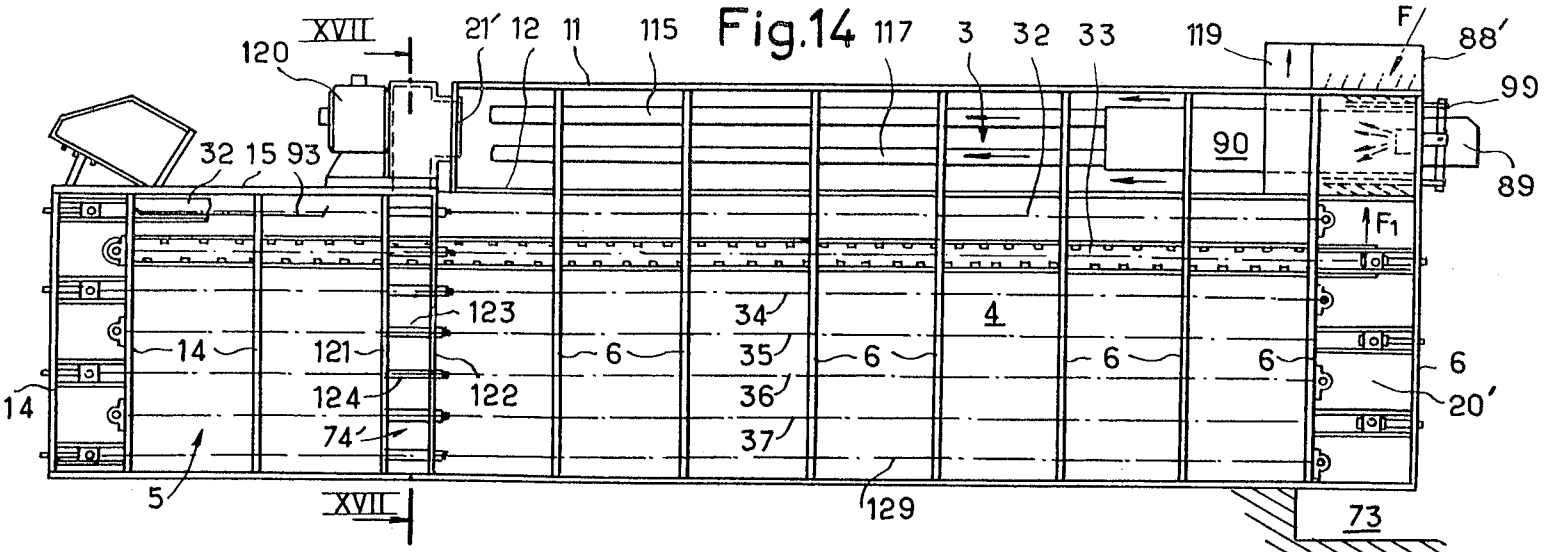
FIG. 14 is a side elevation in the direction of the arrow XIV of FIG. 13, with the side walls removed.
Figure 13:
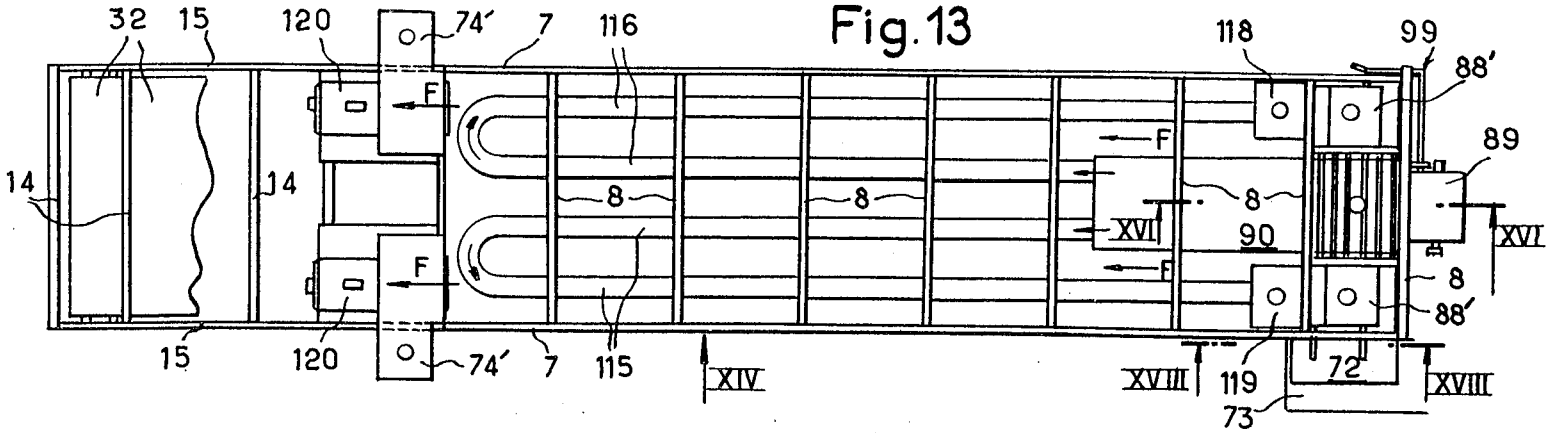
FIG. 13 is a plan, analogous to FIG. 1, of a second embodiment of the invention, with the upper wall removed.

FIGS. 13 and 14 correspond respectively to FIGS. 1 and 2, but show the cooling unit 5 on the left and not on the right. Nevertheless, we will still use the statements "front" to designate the units situated on the side where the products to be dried are fed in and "back" for the units situated at the opposite end.

Figure 15:
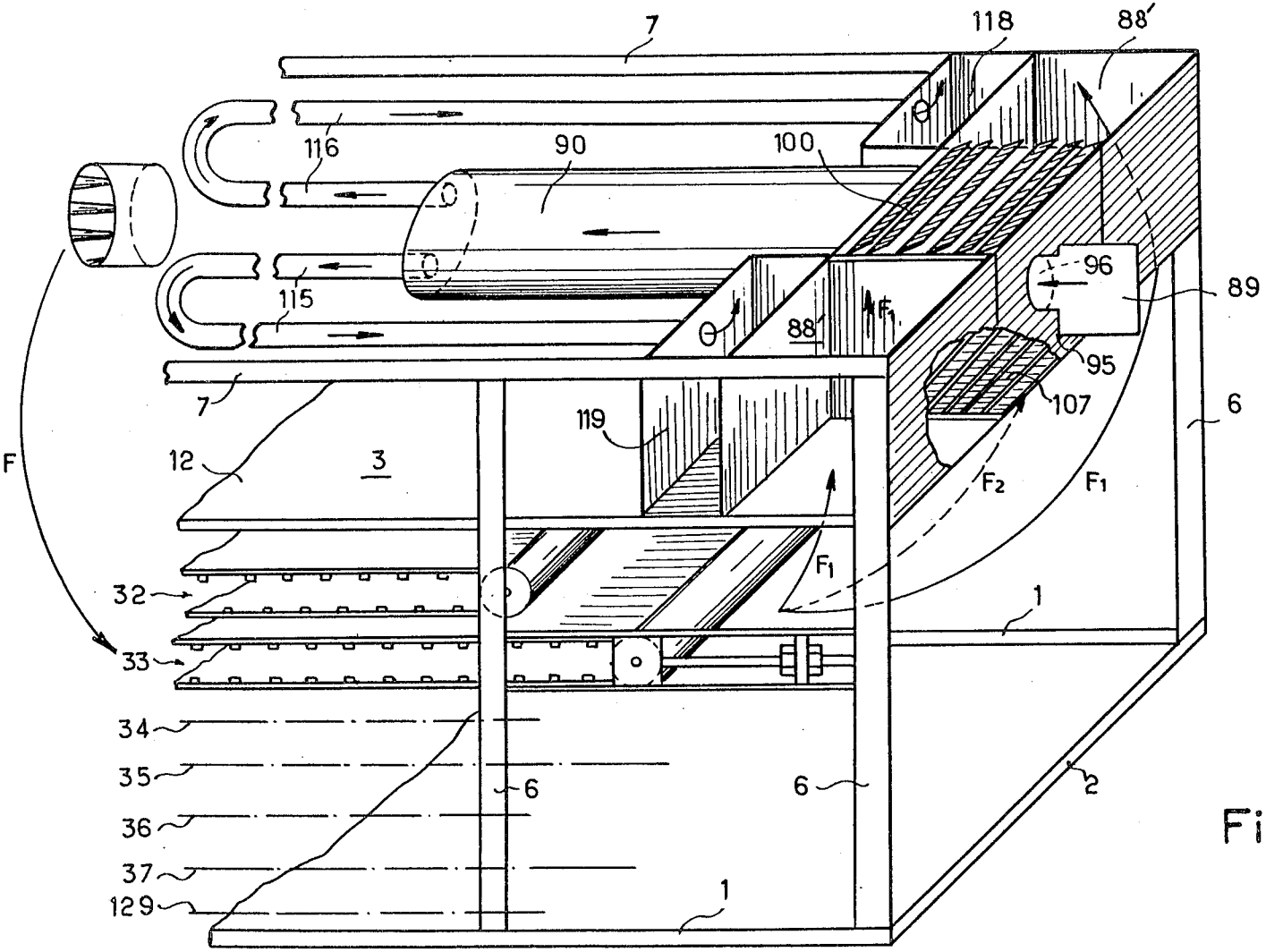
FIG. 15 is a perspective view of the right-hand part of FIGS. 13 and 14.
Figure 16:
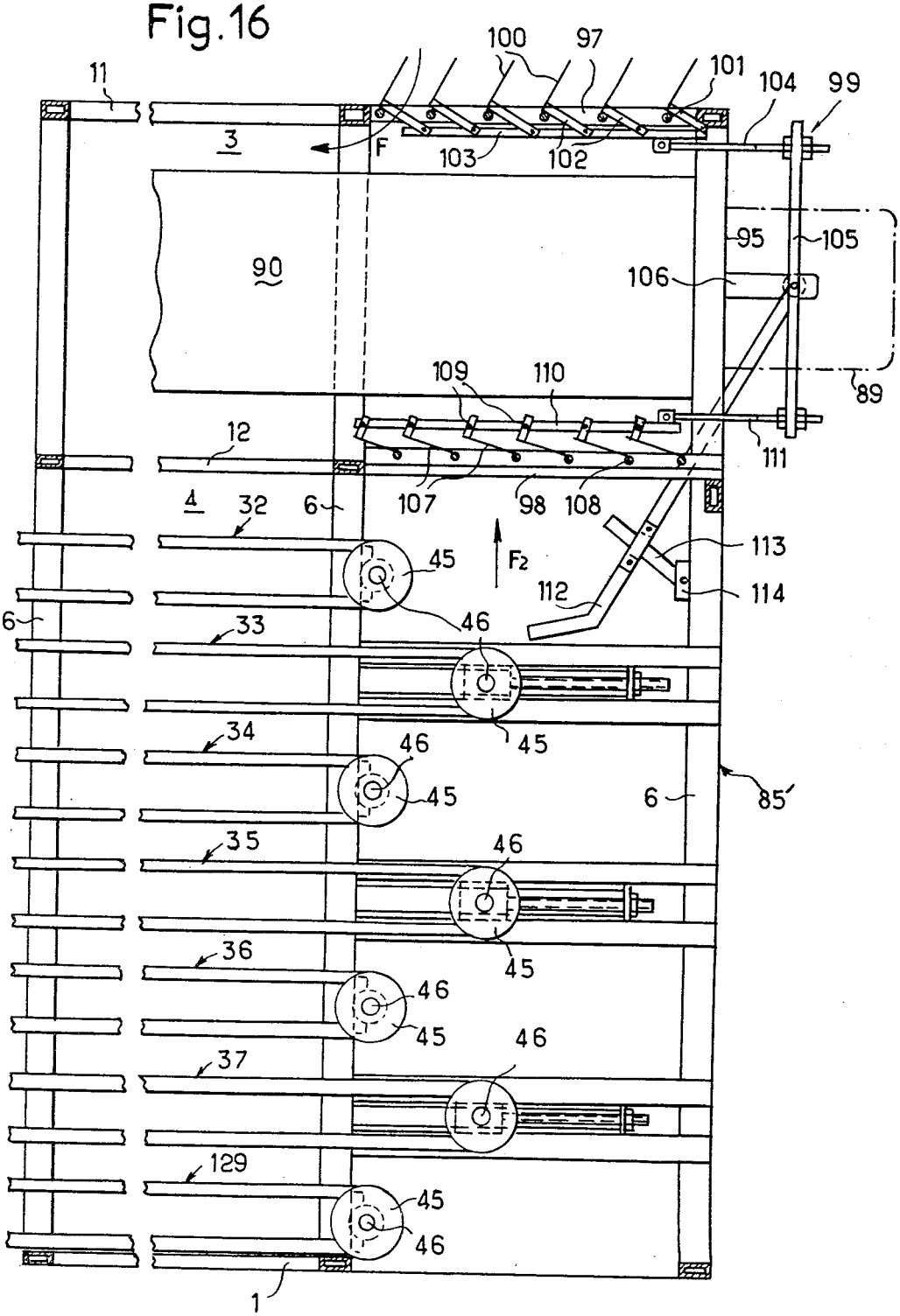
FIG. 16 is a partial section along the line XVI—XVI of FIG. 13.

In FIGS. 13, 15 and 16 and in addition in FIG. 14 one can see a device for recycling moist air in which the rear module forms a vertical column 20' which is bounded either by a part identical to part 85 but whose base 85*b* rests against the uprights 6 which are furthest back in the installation (FIG. 14) or by a rear wall 85' (not represented in FIG. 15) which extends solely between a lower crosspiece 2 and the stringers 9 which carry the horizontal wall 12 separating the heating unit 3 from the drying unit 4 and by two side walls (not shown in the drawing) which are fixed to the two pairs of uprights 6 which are located at the right-hand extremity of FIGS. 13 to 15. Between the level of the wall 12 and the upper plate 11 (not shown in FIGS. 13 and 15) the rear wall is replaced by two chimneys 88' communicating freely at their lower end with the corridor 20' and at their upper end with the atmosphere; between these chimneys there is arranged a housing bounded by the adjacent parallel walls of the two chimneys 88' and by a rear plate 95 situated in the extension of the rear wall or which may form part of this wall and is drilled with an aperture 96 (FIG. 15) which makes the burner 89 connect with a combustion chamber 90 which extends through the abovementioned housing and extends over a certain length into the heating unit 3. Two openings 97 and 98 (FIG. 16) made one above the other, in the upper wall 11 and in the plane of the horizontal wall 12 respectively, and capable of making the abovementioned housing communicate with the outside or with the corridor 20' may be opened or closed alternately by a rod linkage designated as a whole by 99 (FIGS. 13, 14, 16 and 18). More precisely, the opening 97 may be blocked by flaps 100 pivoted at 101 on to rods 102 which in turn are capable of pivoting under the effect of a rod 103 which is actuated via another rod 104 by a rocker unit 105 pivoted in its middle on a support 106 fixed on the outer wall 95 of the abovementioned housing. The opening 98 may be blocked in a similar manner by flaps 107 which pivot at 108 and are integral with rods 109 which in turn pivot on one of the rods 110, 111 (namely 110), the second being connected to the end of the rocker 107 opposite to that to which the rod 104 is connected. The rocker 105 is itself actuated by a lever arm 112 associated with a rod 113 pivoted at 114 on the rear wall 85'.

When the installation is running normally, the flaps 100 are open and the flaps 107 are closed (the position of FIGS. 15 and 16). Consequently the outside air penetrates the heating unit 3 through the opening 97 in the direction of the arrows F of FIGS. 14 and 16 and is heated by the burner 89 in a manner which will be described below. After circulating in the direction of the arrows F (FIGS. 13, 14, 16 and 17) in the heating unit 3 and then in the drying unit 4 at which it arrives through the ventilation corridors 74' as will be described below, the air charged with moisture leaves by the chimneys 88' as shown by the arrows F 1 (FIG. 15).

But if for any reason one wishes to recycle a part of the moist air one operates the rod linkage 99 to close the flaps 100 and open the flaps 107. A small part of the moist air continues to escape through the chimenys 88', but the greater part passes through the aperture 98 in the direction of the arrow F 2 (FIGS. 14 to 16) because of the aspiration effected by the system of fans which will be described below, and the direct arrival of air from the outside through the aperture 97 is interrupted.

In FIGS. 13 to 15 it can be seen that according to another characteristic of the invention, in order to avoid a mixing of the combustion gas with the drying air, the combustion chamber 90 is extended by two U-shaped tubes superimposed in pairs, namely two tubes 115, 116, and two lower tubes 117, only one of which is visible in FIG. 14. The base of each U is near to the extreme front wall 21' of the heating unit and the tubes of each vertical pair end in a common chimney 118,119 (FIGS. 13 to 15) adjacent to each of the chimneys 88'; in this way one ensures a heating of the outside air through the entire length of the heating unit 3 without any pollution of this air being produced.

Figure 17:
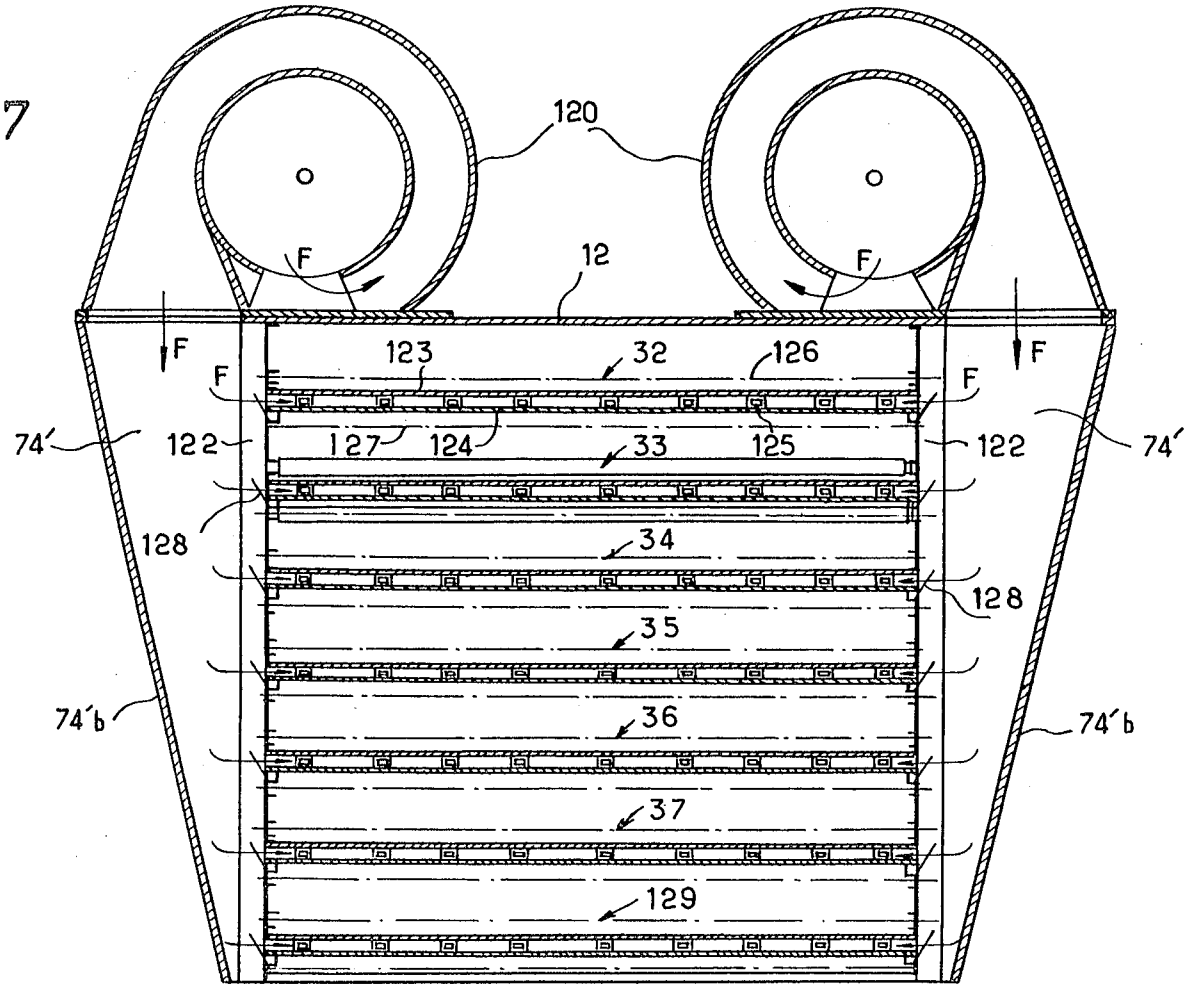
FIG. 17 is a section along the line XVII—XVII of FIG. 14.

In FIGS. 13, 14 and 17 it can be seen that according to another aspect of the invention the circulation of the drying air is carried out in an improved manner as compared with that which has just been described with reference to FIGS. 8 to 10. This circulation is no longer carried out between the superimposed conveyors but in the interior of each of them, that is to say between the two sections of the belt which constitutes the carrying unit of each conveyor.

First of all, the ventilation ducts or corridors 74' preferably comprise the extreme walls **74'*b* which are inclined and not vertical and the air is carried there by two motor/fan sets 120 in the direction of the arrows F (FIGS. 13 to 15 and 17**).

Furthermore, the pair of uprights 6 which, in FIGS. 2 and 3, supports at its upper end the front wall 21 of the heating unit 3, is replaced by two pairs of parallel uprights 121 and 122 (FIG. 14) to which there are fixed, as shown in FIG. 17, air guide corridors each consisting of two horizontal plates 123, 124, fixed on to the abovementioned uprights and projecting slightly towards the rear of the installation, as can be seen in FIG. 14. These plates are maintained spaced by spacing units 125 (FIG. 17), which are preferably hollow, and which extend lengthwise in relation to the associated conveyor but nevertheless permit of the passage of the air over the entire width of this conveyor, the sections of which can be seen at 126, 127 (in broken lines in FIG. 17). As shown in FIG. 14, the ends of the plates 123, 124 which point towards the rear of the installation, that is to say towards the right-hand side of FIG. 14, are slightly inclined towards one another so as to regularize the flow of air. Finally, as in the case of FIG. 9, it is possible to adjust the arrival of air inside each of the conveyors by means of pivoting shutters 128 which play the same part as the shutters 75 and which can be actuated by handles or by any other appropriate means not shown in the drawing.

FIGS. 13 and 14 show that in certain cases it may be advantageous to provide an odd number (7 in the example shown) and not an even number (six in the case of FIGS. 2, 7 and 9) of superimposed conveyors. In FIGS. 14 to 18, the seventh conveyor bears the reference 129. In this case, the discharge of the dried products is carried out by means of a conveyor 72 shown diagrammatically in FIG. 13 but not represented in FIGS. 15 to 18, and housed in a pit 73 arranged underneath the corridor 20', as shown by FIGS. 13 and 14.

Figure 18:
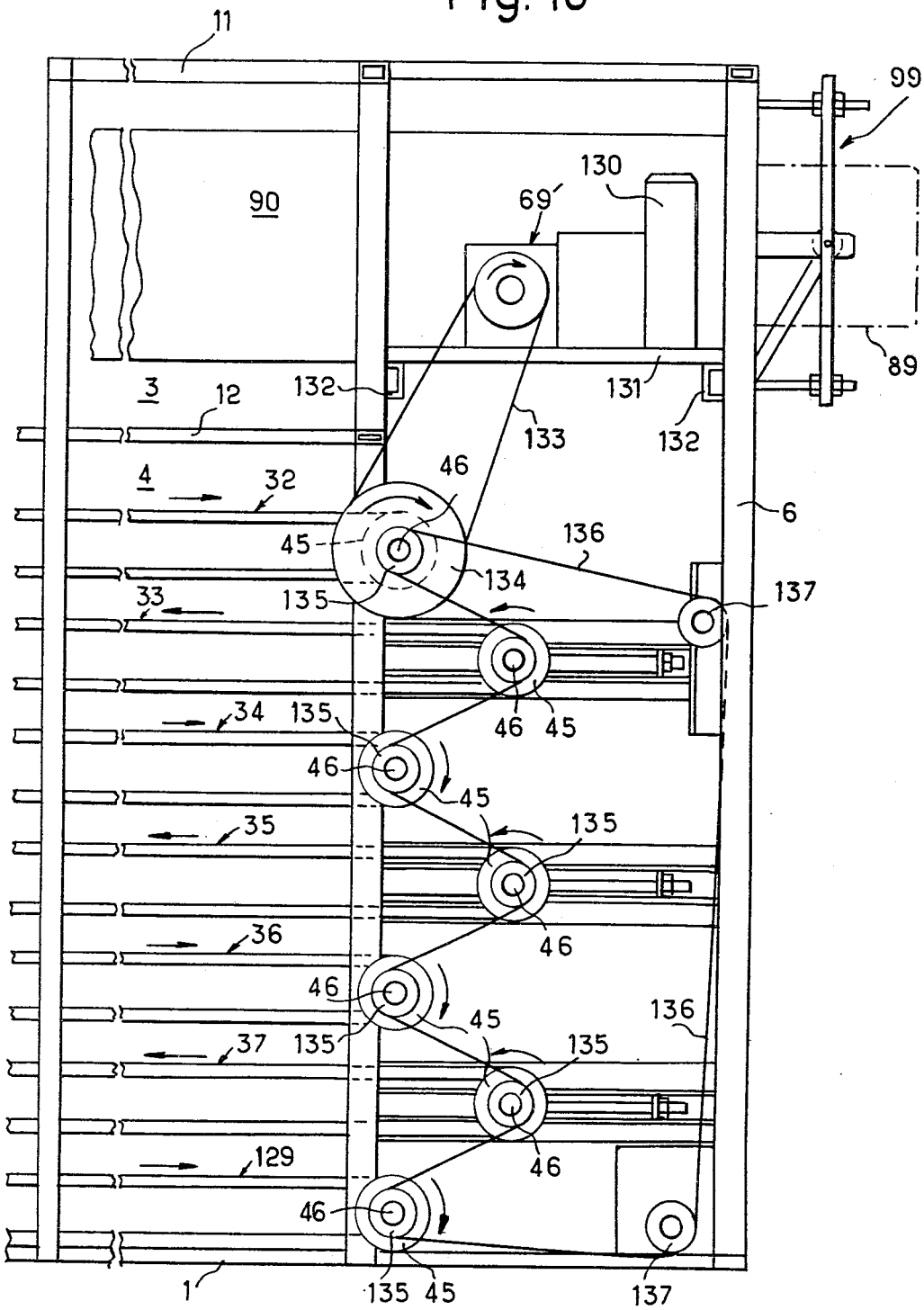
FIG. 18 is a partial elevation along the line XVIII—XVIII of FIG. 13.

Finally, in FIG. 18 it can be seen that the drive of the conveyors is carried out by means of a motor reducing gear as in the case of FIGS. 1 and 6, but this motor reducing gear 69', the speed of which can be adjusted in a known manner by an electronic control unit 130, is carried by a plate 131 which rests on supports 132 fixed to the frame of the installation.

This motor reducing gear is situated on the outside of the installation against the side wall of one of the chimneys 88' for evacuating moist air. A chain (or a belt) 133 connects the motor 69' with a sprocket (or a pulley) 134 mounted on the shaft 46 of the drum 45 for driving the upper conveyor. This shaft, like those of the drums of the other conveyors, carries a sprocket (or a pulley) 135 to take a chain (or a belt) 136 which also passes over two sprockets (or two pulleys) 137 which are carried by the frame of the installation. In this case the control unit 130 also regulates the speed of the pump 58 of FIG. 6, which actuates the jacks 29 for tipping the feed hopper 24 according to the speed of the conveyors 32 to 37 and 129.

The installation functions in the following manner:

The products to be dried—for example fruits—coming from a transport container are tipped into the feed hopper 24. The starting up of the motor 69 or 69′ produces on the one hand, via the transmission of FIG. 6 or that of FIG. 18, the starting up of the conveyors 32 to 37 and possibly 129, and via the pump 58 the gradual tipping of the hopper around the spindle 23. The products tipped into the chute 27 and distributed via the vibrator 28 (which is advantageously also started up by the motor 69 or 69′) via a transmission which is not shown in the drawing, fall on to the upper section of the conveyor 32. Water is fed, preferably as the result of the action of the motor 69 or 69′, to the washing device 91 of FIG. 4, and the washing water is discharged through the tank 93. At the same time the burner 89 has been lit and the motor/fan sets 80 to 84 or 120 suck in the air which arrives through the aperture 97 and has been heated in the heating unit 3 by its contact with the walls of the combustion chamber 90 and of the tubes 115 to 117, and send it into the ducts 74 or 74′, from where it passes along the conveyors 32 to 37 and possibly 129, in the manner which has been described above, as far as the corridors 20 and 20′, to leave by the chimneys 88 or 88′ or, if circumstances require it, to be recycled through the aperture 98 (FIG. 16). The products to be dried are fed by the conveyor 32 of the cooling unit 5 to the upper part of the drying unit 4 and are directed towards the end of the conveyor situated at the rear of the installation. During this section, if one is handling fruits, the loss of water is considerable and the fruits are not greatly heated. At the end of the section, the fruits are tipped out and return on the conveyor 33 which brings them to the cooling unit 5 passing through an air which is hotter and hotter and drier and drier, because this air comes from the corridors 74 or 74′ situated in the immediate vicinity of the unit 5. The passage into an unheated zone avoids any imprisoning of the water in the deep cells of the fruits and leaves it the time to migrate towards the surface layers, at the same time as the cooling is brought about. The latter is facilitated and homogenized by the abovementioned turn round. The fruits thus cooled and whose moisture has been rebalanced are introduced into the drying unit 4 by the conveyor 34 on which they have fallen underneath the chute 27 and as a result of the vibrator 28, and the cycle recommences. The number of conveyors depends on the nature of the products to be dried. At the end of the last cycle, the dried products fall on to the conveyor 72 and are discharged, either into containers or on to a packing chain.

The installation according to the invention can be used for the continuous and automatic drying of products which will not withstand elevated temperatures and through which the migration of the water is slow.

The installation presents over the known systems the advantage that during the evaporation of the surface cells in the manner stated above, the elevation of the temperature is slowed down so that this period may be used to the maximum for producing the drying effect. One therefore achieves a considerable gain in time and a reduction in the energy necessary.

I claim:

1. An apparatus for drying fruits or other products continuously and automatically, comprising a cooling unit, a drying unit disposed laterally adjacent to said cooling unit, a plurality of conveyors extending horizontally and in superposed relation to one another within said drying and cooling units, means for supplying products to be dried to an upper one of said superposed conveyors, driving means coupled to said conveyors for moving said conveyors and products thereon to be dried through said cooling and drying units, means for effecting a generally horizontal flow of hot air through said drying unit from the end of said drying unit adjacent said cooling unit in a direction away from said cooling unit, said last-named means comprising an air heating unit mounted above said drying unit and separated from said drying unit by an intervening horizontal partition and duct means extending from said heating unit into the end of said drying unit adjacent said cooling unit, said driving means being operative to cause adjacent ones of said superposed conveyors to travel in opposing directions respectively and each conveyor being arranged to transfer a product being translated in one direction thereon from one end of said conveyor to a next lower one of said superposed conveyors for translation in the opposing direction, said plurality of superposed conveyors thereby being operative to move said products to be dried away from said cooling unit through said drying unit and thereafter back to said cooling unit in a succession of cycles, whereby as products being dried are conveyed through said drying unit in a direction away from said cooling unit the products pass successively through air which is increasingly less hot and less dry, and as said products thereafter move through said drying unit in a direction back toward said cooling unit the products pass through air which is increasingly hotter and drier before reaching the cooling unit to start a new cycle.

2. The apparatus of claim 1 wherein said drying unit and said cooling unit have substantially the same vertical height, and wherein a plurality of vertically extending flaps are disposed respectively between said plurality of conveyors and between the sections of each of said conveyors for separating said drying and cooling units from one another.

3. The apparatus of claim 1 wherein said cooling and drying units have a common lower horizontal frame structure comprising a plurality of stringers and cross pieces interconnected to one another, said heating unit and drying unit including a plurality of common vertically extending frame structures, disposed in horizontally spaced relation to one another, which bound first modules and which support said intervening horizontal partition and an upper horizontal closing wall for said heating unit, the front one of said vertical frame structures being common to said heating unit, said drying unit and said cooling unit and supporting at its upper part the front end wall of said heating unit, the rear one of said vertical frame structures supporting a rear wall common to said heating unit and to said drying unit, said cooling unit including a further plurality of vertically extending frame structures disposed in horizontally spaced relation to one another and bounding second modules, the height of said further plurality of vertically extending frame structures being less than the height of the said vertically extending frame structure common to said heating unit and drying unit, the front one of said further plurality of frame structures supporting said means for supplying products to be dried to said cooling unit, and chimney means disposed in the one of said first modules which is adjacent the end of said drying unit remote from said cooling unit for exhausting air supplied by said heating unit from said drying unit.

4. The apparatus of claim 1 wherein the length of the rear module common to said heating and drying units and that of the end front module of said cooling unit are significantly less than the lengths of the other modules of the apparatus and receive the ends of the conveyors and their associated driving means.

5. The apparatus of claim 3 including an aperture in said upper closing wall of said heating unit, a further aperture in said intervening horizontal partition, shutter means for controlling the opening and closing of said apertures, and means for adjusting the positions of said shutter means to selectively admit outside air to said heating unit for supply to said drying unit and to control the passage of moisture-laden air from said drying unit for exhaust via said chimney means or, alternatively, to admit a portion of said moisture-laden air from said drying unit to said heating unit for recycling via said heating unit back to said drying unit.

6. The apparatus of claim 1 wherein said means for supplying products to be dried to said cooling unit comprises a feed unit mounted adjacent said cooling unit for swiveling action between a rest position and a charging position, and control means for selectively varying the position of said feed unit.

7. The apparatus of claim 6 wherein said control means for said feed unit includes jacks actuated by a hydraulic pump, and wherein said pump is actuated by a motor reducing gear through a crank plate with adjustable eccentricity, cables the ends of which are anchored by springs to said common lower horizontal frame structure, an adjustable stop, a cursor, a slide and a pawl.

8. The apparatus of claim 1 wherein said heating unit comprises a burner disposed within a combustion chamber, means for admitting air to be heated adjacent said combustion chamber in isolation to the combustion products within said chamber, said duct means comprising a pair of vertical ducts disposed between said heating unit and said drying unit at the end of said drying unit adjacent to said cooling unit, blower means for impelling heated air from said heating unit downwardly through said ducts into said drying unit, and pivotal shutter means adjacent said ducts for controlling the flow of air from said ducts into said drying unit.

9. The apparatus of claim 8 including a plurality of U-shaped tubes superimposed in pairs and connected to said heating unit, the base portion of each of said U-shaped tubes being disposed at the end of said drying unit adjacent to said cooling unit, one end of each of said tubes being connected to said combustion chamber, and the other end of each tube communicating with a chimney.

10. The apparatus of claim 8 wherein said pivotal shutter means are arranged between said intervening horizontal partition and the upper one of said conveyors as well as between the conveyors which are situated below said upper conveyor, means for actuating said pivotal shutter means, said actuating means including handles situated on the outside of said ducts, and deflectors at the top and bottom of said ducts.

11. The apparatus of claim 1 wherein said flow of hot air is directed between the sections of each conveyor by means of guide corridors supported at the boundary between said drying unit and said cooling unit by two pairs of uprights aligned longitudinally in relation to said apparatus, said uprights comprising at their ends adjacent said duct means pivoting shutters which project slightly into said drying unit and each of which consists of two parallel horizontal metal sheets which are fixed to said uprights, said shutters being maintained in spaced relation by spacing units, and said shutters being slightly inclined towards one another at their ends pointing towards the rear of the apparatus so as to effect a regularized flow of air over the entire width of the conveyors.

12. The apparatus of claim 1 wherein said plurality of conveyors comprises an even number of conveyors, and a further conveyor disposed at right angles to and below the lowermost one of said plurality of conveyors adjacent the end of said cooling unit remote from said drying unit for discharging the dried products from said cooling unit.

13. The apparatus of claim 12 wherein an articulated chute is connected to said further conveyor for receiving said dried products from said further conveyor.

14. The apparatus of claim 1 wherein said plurality of conveyors comprises an odd number of conveyors, and a further conveyor disposed at right angles to and below the lowermost one of said plurality of conveyors adjacent the end of said drying unit remote from said cooling unit for discharging the dried products.

15. The apparatus of claim 14 wherein an articulated chute is connected to said further conveyor for receiving said dried products from said further conveyor.

16. The apparatus of claim 1 wherein said driving means for said conveyors include ratchet wheels which are actuated by a motor reducing gear through a crank plate having an adjustable eccentricity, cables the ends of which are anchored by springs to said common lower horizontal frame structure, adjustable stops, cursors, slides and pawls.

17. The apparatus of claim 1 including chimney means for evacuating moist air from said drying unit, said driving means for said conveyors including a motor reducing gear, an electronic control unit for adjusting the speed of said gear, said motor reducing gear being situated on the outside of the apparatus against a wall of said chimney means and being operative to actuate through an endless driving means a driving wheel integral with the end of the shaft of a drum of the upper conveyor, each of the shafts of the drums of all said conveyors supporting a driving wheel upon which run endless driving means which pass over two return wheels integral with the frame of the apparatus.

* * * * *